US005160309A

United States Patent [19]

Robertsson

[11] Patent Number: 5,160,309

[45] Date of Patent: Nov. 3, 1992

[54] CENTRIFUGAL SEPARATOR WITH PUMPING MEANS, ARRANGED TO ACCOMPLISH A CIRCULATING FLOW

[75] Inventor: Gösta Robertsson, Trangsund, Sweden

[73] Assignee: Alfa-Laval Separation AB, Tumba, Sweden

[21] Appl. No.: 602,253

[22] PCT Filed: Apr. 16, 1989

[86] PCT No.: PCT/SE89/00138

§ 371 Date: Nov. 1, 1990

§ 102(e) Date: Nov. 1, 1990

[87] PCT Pub. No.: WO89/10793

PCT Pub. Date: Nov. 16, 1989

[30] Foreign Application Priority Data

May 2, 1988 [SE] Sweden ..... 8801649

[51] Int. Cl.[5] ..... B04B 1/00

[52] U.S. Cl. ..... 494/43

[58] Field of Search ..... 494/27, 43, 48, 56, 494/58, 59, 67, 68, 69, 70; 210/781, 782

[56] References Cited

U.S. PATENT DOCUMENTS 4,510,052 4/1985 Eklof ..... 494/27

4,820,256 4/1989 Nordstrom ..... 494/27

FOREIGN PATENT DOCUMENTS 497052 12/1938 United Kingdom ..... 494/56

*Primary Examiner*—Philip R. Coe

*Assistant Examiner*—Randall E. Chin

*Attorney, Agent, or Firm*—Seidel, Gonda, Lavorgna & Monaco

[57] ABSTRACT

In a centrifugal separator there is formed within the rotor a separating chamber (7) and a central chamber (26), which latter communicates with a peripheral part of the separating chamber through a channel (19*a*, 19*b*). The part (19*a*) of the channel situated closest to the central chamber (26) extends substantially parallel with the rotor axis, whereas the other channel part (19*b*) forms an angle with the rotor axis. For avoiding that solids entrained by liquid entering the channel (19*a*, 19*b*) from the separating chamber (7) are separated and depositing on the outer wall of the inner channel part (19*a*) a partition member (44) is arranged in this inner channel part (19*a*). The partition member (44) divides the channel part (19*a*) into two parallel flow ways (45, 46). Further, a pumping means (31) is arranged to pump liquid from the central chamber (26) to one (45) of said flow ways, so that this liquid flows through first said one (45) and then said other (46) flow way and then flows back to the central chamber (26). By the liquid circulation thus established in the inner channel part (19*a*) the solids are maintained suspended in the liquid until it again leaves the channel part (19*a*).

12 Claims, 2 Drawing Sheets

CENTRIFUGAL SEPARATOR WITH PUMPING MEANS, ARRANGED TO ACCOMPLISH A CIRCULATING FLOW

The present invention relates to a centrifugal separator for separation of solids from a suspension, comprising a rotor that forms a separating chamber having a central part and a peripheral part, means defining within the rotor a central chamber and a channel, which latter connects the central chamber with said peripheral part of the separating chamber, a first part of the channel close to the central chamber extending substantially parallel with the rotor axis, and a second part of the channel forming an angle with the rotor axis and extending from said first channel part to the peripheral part of the separating chamber.

A centrifugal separator of this kind is disclosed for instance in U.S. Pat. Nos. 3,752,389 and 4,525,155.

A problem in connection with operation of a centrifugal separator of this kind is that solid particles in the treated suspension are entrained by liquid into said channel and are depositing on the radially outer wall of said first part of the channel extending substantially in parallel with the rotor axis. In certain cases it has proved that such depositing of particles has entirely, or to a substantial degree, blocked liquid flow through the channel and, thereby, jeopardized the intended function of the centrifugal separator.

As can be seen from said patent specification the channel in question in a centrifugal separator of this kind may have different functions. In the centrifugal separator according to U.S. Pat. No. 4,525,155 the channel is intended to be flowed through intermittently by a relatively heavy liquid that has been separated in the rotor and is to be discharged therefrom. In the centrifugal separator according to U.S. Pat. No. 3,752,389 the corresponding channel is both to be flowed through intermittently by separated heavy liquid to be discharged from the rotor and, substantially continuously, to be flowed through by a small flow of liquid intended for sensing purpose. In both these cases particles will be entrained by liquid from the separating chamber into the channel and deposit on the radially outer wall of said first part of the channel. Since this outer wall has only an insignificant inclination, or no inclination at all, relative to the rotor axis, particle deposits thereon cannot move along the outer wall as a consequence of the centrifugal force. Therefore, they remain and cause clogging of the channel.

A different function of said channel may be to transfer liquid intermittently from a stationary member to the radially outermost part of the separating chamber. Such liquid may be a so called displacement liquid that is supplied to the separating chamber in a certain amount immediately before a brief opening of the peripheral outlets of the separating chamber. It has proved in practice that clogging problems have arisen even in these cases—probably as a consequence of particles having been entrained by liquid from the separating chamber into said channel after each time the peripheral outlets of the separating chamber have been opened. The particles then have deposited on said outer wall in the first part of the channel, where they have remained even during the repeated periods of time when the channel has been emptied of liquid. New particles then have been entrained by liquid from the separating chamber into the channel, etc.

The object of the present invention is to avoid collection of particles in said first part of the channel in a centrifugal separator of the initially described kind.

This object may be obtained in that the centrifugal separator comprises a pumping means, for instance of the kind shown in U.S. Pat. No. 4,525,155, which is arranged during operation of the rotor to pump liquid out of the central chamber and thereby to establish a liquid flow through the initially mentioned channel and into the central chamber, and that this pumping means is arranged to pump liquid from the central chamber to an area in said channel so situated that a circulation of the pumped liquid will come up in a flow circuit comprising said first part of the channel, the central chamber and the pumping means.

Preferably, the pumping means is arranged to pump liquid from the central chamber to the area of the channel, where said parts of the channels communicate with each other. However, pumping of liquid from the central chamber to any area within said second part of the channel will create a circulation flow of liquid through said first part of the channel without by itself causing solids to pass from the separating chamber into the channel.

By this invention a so strong liquid flow can constantly be maintained in said first part of the channel that particles present in the liquid are prevented from separating from the liquid and depositing on the outer wall of said channel part. Particles entrained by liquid into said channel part will thus accompany the liquid even out of it.

This means in a case such as the one according to U.S. Pat. No. 3,752,389, where a small flow of liquid is to be maintained continuously from the radially outer part of the separating chamber and out of the rotor through said channel, that a substantially stronger flow of liquid may be obtained at least in said first channel part, in which the radially outer wall extends substantially parallel with the rotor axis.

In a case where the channel is intended only for a liquid flow from the central chamber to the separating chamber, the invention means that particles which cannot be prevented from accompanying the liquid from the separating chamber into the channel can be maintained suspended in the liquid until it flows back to the separating chamber in connection with opening of its peripheral outlets for separated solids.

A preferred embodiment of the invention is characterized in that the rotor has a partition member, which is formed and arranged such in said first part of the channel that this channel part is divided into at least two parallel flow ways; that only one of the flow ways is connected to the central chamber, and that the pumping means is arranged to pump liquid from the central chamber to the other flow way, so that liquid will flow in a direction away from the central chamber along said other flow way and in a direction towards the central chamber along said one flow way. Hereby, the pumping means may be given a short axial extension in that the inlet and outlet of the pumping means may be situated axially very close to each other.

Said partition member, within the scope of the invention, may divide said first channel part into several flow ways which are situated at the same distance from the rotor axis and are evenly distributed therearound. For instance, every second one of the flow ways may be connected to the central chamber in order to be flowed through by liquid in one direction, whereas the rest of the flow ways are arranged to receive liquid from the pumping means in order to be flowed through by liquid in the opposite direction.

Preferably, however, the partition member divides the first channel part in a radially inner and a radially outer flow way, which flow ways extend substantially annularly around the rotor axis.

The invention is described in the following with reference to the accompanying drawing.

Figure 1:
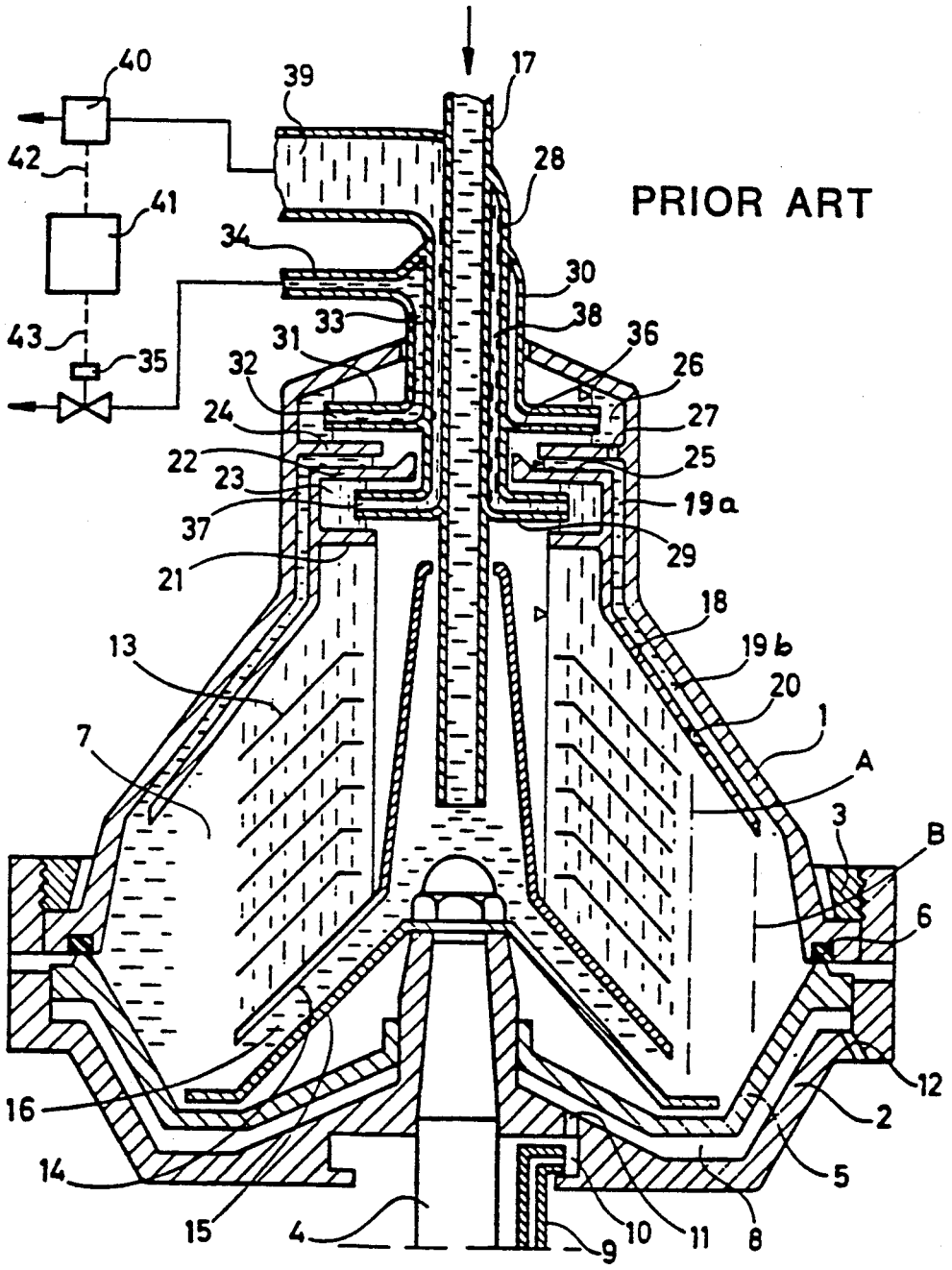
FIG. 1 shows part of a previously known centrifugal separator, seen in an axial section.

The previously known centrifugal separator in FIG. 1 comprises a rotor consisting of two parts 1 and 2, which are kept together by means of a locking ring 3. The rotor is supported by a drive shaft 4.

Within the rotor a slide 5 is axially movable to and from sealing against an annular gasket 6. Between the slide 5 and the upper rotor part 1 a separating chamber 7 is defined, and between the slide 5 and the lower rotor part 2 a chamber 8 is defined and intended to contain so called operating liquid.

Means 9 are arranged for supply of operating liquid to a space 10 defined in the rotor part 2, from which space a channel 11 leads to the said chamber 8. A throttled channel 12 leads from the radially outermost part of the chamber 8 through the rotor part 2 to the outside of the rotor.

In the separating chamber 7 a set of conical separating discs 13 is arranged. These rest on a so called distributor 14, which in the lower part of the rotor forms together with a conical disc 15 an inlet 16 to the separating chamber 7.

The upper part of the distributor 14 surrounds a central space in the rotor, into which a stationary pipe 17 extends for the supply of a mixture of components to be separated in the rotor.

On the top of the set of discs in the separating chamber (only a few discs 13 are shown in the drawing) there is resting a conical top disc 18, which is thicker than the discs 13 and extends somewhat longer radially outwards than these in the separating chamber. The disc 18 forms together with the upper rotor part 1 a channel consisting of two channel parts 19*a* and 19*b*, and has at about the radial level of the outer edges of the separating discs a through-hole 20. The channel part 19*a* extends substantially parallel with the rotor axis, whereas the channel part 19*b* forms an angle with the rotor axis.

In the upper part of the rotor the top disc 18 has two radially inwards directed annular flanges 21 and 22, which between themselves form a chamber 23. The upper flange 22 extends longer radially inwards than the flange 21. Above the uppermost flange 22 the upper rotor part 1 has an inwardly directed annular flange 24, which extends radially inwards somewhat longer than the lowermost flange 21. Between the flanges 24 and 22 there is left a space 25 communicating through the channel 19*a*, 19*b* with the separating chamber 7.

Between the uppermost portion of the rotor part 1 and the flange 24 supported thereby there is formed a chamber 26 which communicates with said space 25 through a calibrated opening 27 in the flange 24.

The previously described inlet pipe 17 supports a pipe 28, which coaxially surrounds the inlet pipe and at its lower end supports a so called paring disc 29. The paring disc 29 is arranged in the before-mentioned chamber 23.

In its turn the pipe 28 supports a surrounding pipe 30, which at its lower end supports a paring disc 31. The paring disc 31 is arranged within the before-mentioned chamber 26 and has several channels 32—distributed around the paring disc—which through an annular channel 33 communicate with an outlet conduit 34. In the outlet conduit 34 there is arranged a closing valve 35.

In one or some of its channels 32 the paring disc 31 has a calibrated opening 36, which thus constitutes a calibrated outlet from the connection extending between the chamber 26 and the valve 35.

The previously mentioned paring disc 29 has paring channels 37, which through an annular channel 38 communicate with a conduit 39. In the conduit 39 sensing means 40 of some conventional kind is arranged to sense if a certain liquid flowing through the conduit 39 contains fractions of another liquid.

A control equipment 41 is connected via connections 42 and 43 to the sensing means 40 and the valve 35, respectively.

The above described centrifugal separator may be used for cleaning of oil, for instance heavy fuel oil, from water and solid particles. A mixture of these components, heated to about 100° C., is to be supplied to the centrifuge rotor through the conduit 17, from where it will flow through the channel 16 into the separating chamber 7.

At this stage the chamber 8 between the slide 5 and the rotor part 2 is filled with operating water, so that the slide 5 is kept pressed against the gasket 6. A small amount of operating water constantly leaves the chamber 8 through the hole 12, but a corresponding amount of new operating water is continuously supplied through the means 9.

In the separating chamber 7 separated oil moves towards the rotor centre and flows into the chamber 23, from which it is pumped by the paring disc 29 through the channels 37 and 38 to the outlet conduit 39. The radially inwards directed annular flange 21 forms an overflow outlet from the separating chamber for the separated oil, so that the liquid level in the separating chamber is determined by the position of the inner edge of the flange 21.

Separated oil will flow towards the rotor centre also in the channel 19*a*, 19*b* between the top disc 18 and the rotor part 1. From the channel part 19*a* the oil enters the central space 25, where a free liquid surface is formed at the same level as in the separating chamber 7.

A certain amount of oil flows through the calibrated opening 27 in the flange 24 into the chamber 26. From there oil is pumped by the paring disc 31 through the channels 32 and 33 out into the conduit 34 to the valve 35. In a starting position the valve 35 is closed and, therefore, no further oil flow through the conduit 34 will take place after the channels 32 and 33 and the conduit 34 have been filled. The paring disc 31 will continue, however, to pump oil out of the chamber 26, which oil leaves through the calibrated outlet 36 some distance within one of the paring disc channels 32. The oil flowing out through the outlet 36 will enter the space 25, where it cannot influence on the liquid level and from where it may again flow into the chamber 26 through the opening 27.

By the constant pumping of oil out of the chamber 26 the free liquid surface therein may be kept at a level radially outside of the free liquid surface in the space 25 while the valve 35 in the conduit 34 is closed.

When after some time of operation so much separated water has been collected in the radially outer part of the separating chamber that the interface layer between oil and water is situated at a level A in the separating chamber, fractions of water start to be entrained by the separated oil leaving through the conduit 39. This is sensed by the means 40, which emit a signal to the control equipment 41. In turn the control equipment 41 causes the valve 35 to open and to be kept open during a predetermined period of time. During this period of time so much separated water leaves the separating chamber 7 through the channel 19*a*, 19*b*, passing through the flow determining opening 27 in the flange 24, that the interface layer in the separating chamber between oil and water moves to a level B.

After the valve 35 has been closed, the water which in this stage is present within the chamber 26, the space 27 and the channel 19*a*, 19*b* will flow back to the separating chamber, oil then flowing through the hole 20 in the top disc 18 and refilling said spaces to the levels shown in the drawing.

In the way described above separated water may be intermittently conducted away from the separating chamber 7. Solid particles having been separated in the separating chamber as a rule have to be discharged more seldomly. This can be accomplished by occasionally interrupting the supply of operating water through the supply means 9. The control equipment 41 then may be so programmed, that for instance every fourth time a signal is emitted thereto, indicating that the interface layer between oil and water in the separating chamber has reached the level A, the valve 35 is maintained closed, whereas instead the supply of operating liquid to the means 9 is occasionally interrupted. In this way the slide 5 is caused to move axially downwards leaving an open slot between itself and the gasket 6. Separated solids and a desired amount of water then leave the separating chamber 7 through this slot and through ports situated radially outside of the slot in the rotor part 2.

Figure 2:
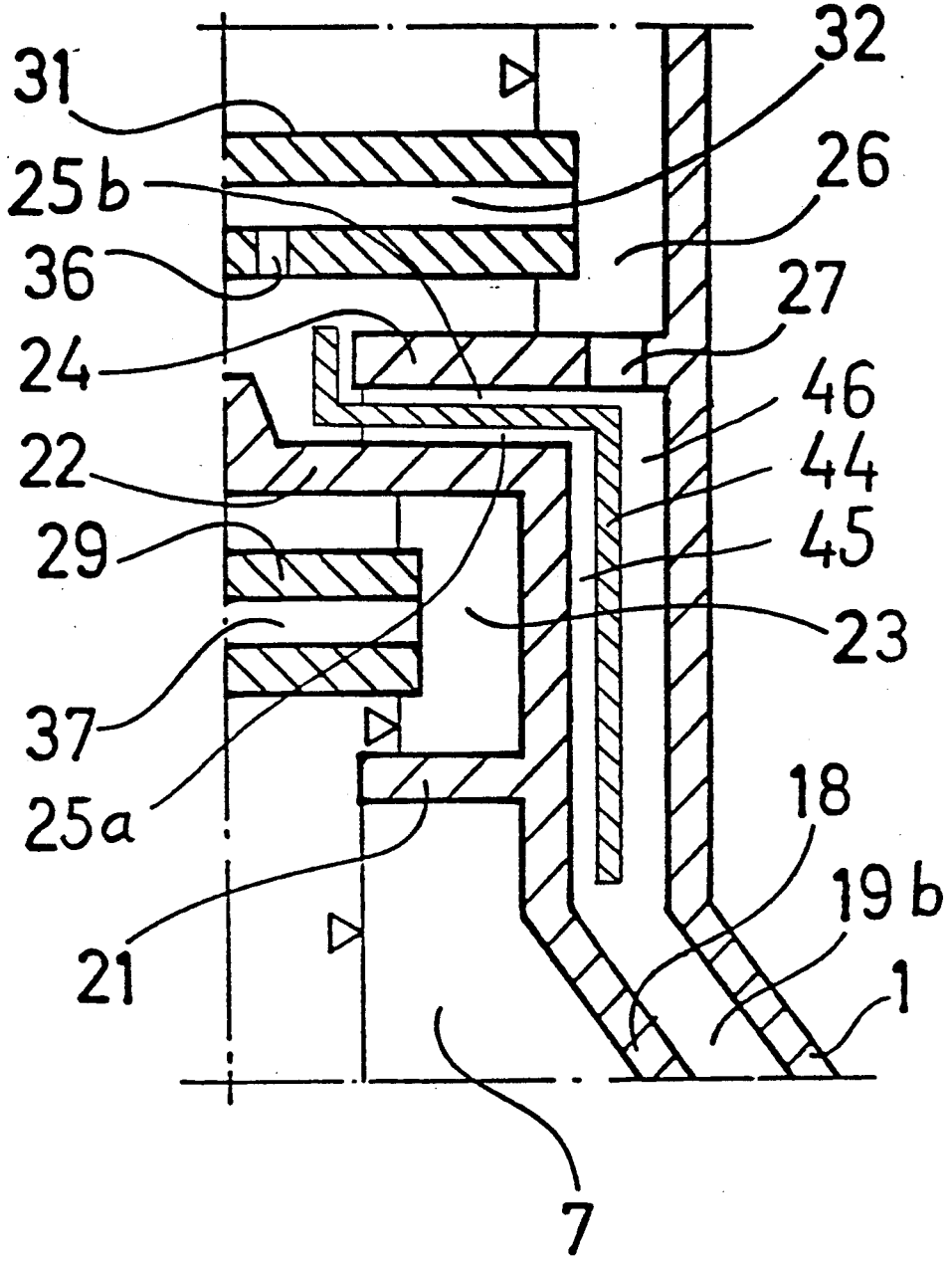
FIG. 2 shows a part of the centrifugal separator according to FIG. 1, which has been modified in accordance with the invention.

FIG. 2 shows a part of the centrifugal separator according to FIG. 1, which has been provided with an annular partition member 44. A cylindrical part of the partition member 44 divides the channel part 19*a* (FIG. 1) in a radially inner flow way 45 (FIG. 2) and a radially outer flow way 46 (FIG. 2), whereas a plane part of the partition member 44 divides the space 25 (FIG. 1) into a lower compartment 25*a* (FIG. 2) communicating with said inner flow way 45, and an upper compartment 25*b* (FIG. 2) communicating with said outer flow way 46.

The partition member 44 also has a radially inner part in the form of a short cylinder extending axially past and radially inside of the flange 24. This part of the partition member is situated at a distance from the rotor axis which is larger than that for each opening 36 in the paring disc 31. Thereby it is assured that liquid flowing out of the paring disc 31 through the opening 36 is supplied to the lower compartment 25*a*.

During operation of the centrifugal separator according to FIG. 2 liquid will thus always be pumped by means of the paring disc 31 from the chamber 26 through the opening 36 to the compartment 25*a*. Hence, the liquid flows further on through the flow way 45 to the lowermost end of the partition member 44, where it turns around and flows in the opposite direction through the flow way 46 and the calibrated opening 27 back to the chamber 26. A liquid flow of this kind will be maintained even when the valve 35 in the conduit 34 (FIG. 1) is closed, whereby is prevented that solids having been entrained by the liquid from the separating chamber 7 through the channel part 19*b* to the channel part 19*a* (FIG. 1) are separated and deposit in the channel 19*a*. Accompanying particles of this kind will instead remain suspended in the liquid being circulated by means of the paring disc 31 in the flow circuit 26, 32, 36, 25*a*, 45, 46 and 27, and they will accompany the liquid sooner or later when it leaves the flow circuit. This occurs either through the conduit 34, when the valve 35 is opened, or through the channel part 19*b*, when the slide 5 is moved axially for discharge of separated sludge from the separating chamber 7.

It is possible that part of the particles, which are being entrained by the circulating liquid while the valve 35 is closed, are separated at the lowermost end of the partition member 44 and are returned by the centrifugal force to the separating chamber 7 through the channel part 19*b*.

The invention has been described above in connection with a centrifugal separator in which the paring disc 31 is arranged to pump a separated relatively heavy liquid out of the rotor. The invention advantageously may be used also in connection with a centrifugal separator, the rotor of which has only two outlets, i.e. a central outlet intended for a separated relatively light liquid and a peripheral outlet intended for both separated solids and a separated relatively heavy liquid.

I claim:

1. A centrifugal separator for the separation of solids from a liquid suspension, comprising a rotor, the rotor forming a separating chamber having a central part and a peripheral part, means defining within the rotor a central chamber and a channel, the channel having two ends, one said end communicating with the central chamber and the opposite end communicating with the peripheral part of the separating chamber, a first part of the channel being positioned close to the central chamber and extending substantially parallel with the rotor axis, a second part of the channel forming an angle with the rotor axis and extending from the first channel part to the peripheral part of the separating chamber, and pumping means arranged during operation of the rotor to pump liquid out of the central chamber and, thereby, to accomplish a liquid flow through said channel and into the central chamber, wherein the pumping means is arranged to pump liquid from the central chamber to an area of said channel spaced from said opposite end thereof communicating with the separation chamber such that a recirculation flow of the pumped liquid will be established spaced from this opposite end of the channel, the recirculation flow forming a flow circuit comprising said first part of the channel, the central chamber and the pumping means.

2. A centrifugal separator according to claim 1, wherein the pumping means is arranged to pump liquid from the central chamber to an area of said channel, where said channel parts communicate with each other.

3. A centrifugal separator for separation of solids from a liquid suspension, comprising a rotor, the rotor forming a separating chamber having a central part and a peripheral part, means defining within the rotor a central chamber and a channel, the channel connecting the central chamber with the peripheral part of the separating chamber, a first part of the channel close to the central chamber extending substantially parallel with the rotor axis and a second part of the channel forming an angle with the rotor axis and extending from the first channel part to the peripheral part of the separating chamber, and pumping means arranged during operation of the rotor to pump liquid out of the central chamber and, thereby, to accomplish a liquid flow through said channel and into the central chamber, wherein the pumping means is arranged to pump liquid from the central chamber to an area of said channel so situated that a circulation flow of the pumped liquid will be established and forming a flow circuit comprising said first part of the channel, the central chamber and the pumping means, the rotor having a partition member, the partition member being formed and arranged such that said first part of the channel is divided into at least two parallel flow ways, only one of said flow ways being connected to the central chamber, and the pumping means being arranged to pump liquid from the central chamber to the other flow way, so that liquid flows in a direction from the central chamber along said other flow way and in a direction towards the central chamber along said one flow way.

4. A centrifugal separator according to claim 3, wherein the partition member divides the first channel part in a radially inner flow way and a radially outer flow way.

5. A centrifugal separator according to claim 4, wherein the partition member is substantially annular.

6. A centrifugal separator according to claim 3, wherein means is arranged to maintain during operation of the rotor a free liquid surface at a predetermined radial level in a space formed in the rotor and communicating through said first and second parts of the channel with the separating chamber, a further partition in the rotor separates the central chamber from said one flow way in the first channel part and has at least one calibrated through-hole, the partition member and further partition define a radially inward open space in the rotor, which communicates with said one flow way in the first channel part and the partition member extends radially inward in the rotor to a level inside said predetermined radial level.

7. A centrifugal separator for separation of solids from a liquid suspension, comprising a rotor, the rotor forming a separating chamber having a central part and a peripheral part, means defining within the rotor a central chamber and a channel, the channel connecting the central chamber with the peripheral part of the separating chamber, a first part of the channel close to the central chamber extending substantially parallel with the rotor axis and a second part of the channel forming an angle with the rotor axis and extending from the first channel part to the peripheral part of the separating chamber, and pumping means arranged during operation of the rotor to pump liquid out of the central chamber and, thereby, to accomplish a liquid flow through said channel and into the central chamber, wherein the pumping means is arranged to pump liquid from the central chamber to an area of said channel so situated that a circulation flow of the pumped liquid will be established and forming a flow circuit comprising said first part of the channel, the central chamber and the pumping means, the pumping means being arranged to pump liquid from the central chamber to an area of said channel, where said channel parts communicate with each other, the rotor having a partition member formed and arranged such that said first part of the channel is divided into at least two parallel flow ways, one of said flow ways being connected to the central chamber, and the pumping means being arranged to pump liquid from the central chamber to the other flow way so that liquid flows in a direction from the central chamber along said other flow way and in a direction towards the central chamber along said one flow way.

8. A centrifugal separator according to claim 7, wherein the partition member divides the first channel part in a radially inner flow way and a radially outer flow way.

9. A centrifugal separator according to claim 8, wherein the partition member is substantially annular.

10. A centrifugal separator according to claim 9, wherein means is arranged to maintain during operation of the rotor a free liquid surface at a predetermined radial level in a space formed in the rotor and communicating through said first and second parts of the channel with a separating chamber, a further partition in the rotor separates the central chamber from said one flow way in the first channel part and has at least one calibrated through-hole, the partition member and further partition define a radially inward open space in the rotor which communicates with said one flow way in the first channel part, and the partition member extends radially inward in the rotor to a level inside said predetermined radial level.

11. A centrifugal separator for separation of solids from a liquid suspension, comprising a rotor, the rotor forming a separating chamber having a central part and a peripheral part, means defining within the rotor a central chamber and a channel, the channel having two ends and connecting the central chamber through one of its ends with the peripheral part of the separating chamber through its other end, a first part of the channel close to the central chamber extending substantially parallel with the rotor axis and a second part of the channel forming an angle with the rotor axis and extending from the first channel part to the peripheral part of the separating chamber, and pumping means arranged during operation of the rotor to pump liquid out of the central chamber and, thereby, to accomplish a liquid flow through said channel and into the central chamber, wherein the pumping means is arranged to pump liquid from the central chamber to an area of said channel so situated that a circulation flow of the pumped liquid will be established spaced from said other end of the channel and forming a flow circuit comprising said first part of the channel, the central chamber and the pumping means, the rotor having a partition member, the partition member being formed and arranged such that said first part of the channel is divided into at least two parallel flow ways, only one of said flow ways being connected to the central chamber, and the pumping means being arranged to pump liquid from the central chamber to the other flow way, so that liquid flows in a direction from the central chamber along said other flow way and in a direction towards the central chamber along said one flow way.

12. A centrifugal separator for separation of solids from a liquid suspension, comprising a rotor, the rotor forming a separating chamber having a central part and a peripheral part, means defining within the rotor a central chamber and a channel, the channel having two ends and connecting the central chamber through one of its ends with the peripheral part of the separating chamber through its other end, a first part of the channel close to the central chamber extending substantially parallel with the rotor axis and a second part of the channel forming an angle with the rotor axis and extending from the first channel part to the peripheral part of the separating chamber, and pumping means arranged during operation of the rotor to pump liquid out of the central chamber and, thereby, to accomplish a liquid flow through said channel and into the central chamber, wherein the pumping means is arranged to pump liquid from the central chamber to an area of said channel so situated that a circulation flow of the pumped liquid will be established spaced from said other end of the channel and forming a flow circuit comprising said first part of the channel, the central chamber and the pumping means, the pumping means being arranged to pump liquid from the central chamber to an area of said channel, where said channel parts communicate with each other, the rotor having a partition member formed and arranged such that said first part of the channel is divided into at least two parallel flow ways, one of said flow ways being connected to the central chamber, and the pumping means being arranged to pump liquid from the central chamber to the other flow way so that liquid flows in a direction from the central chamber along said other flow way and in a direction towards the central chamber along said one flow way.

* * * * *